US009217221B2

(12) United States Patent
Catoe

(10) Patent No.: US 9,217,221 B2
(45) Date of Patent: Dec. 22, 2015

(54) POCKET INVERTER

(71) Applicant: Michael W. Catoe, Lexington, SC (US)

(72) Inventor: Michael W. Catoe, Lexington, SC (US)

( * ) Notice: Subject to any disclaimer, the term of this patent is extended or adjusted under 35 U.S.C. 154(b) by 0 days.

(21) Appl. No.: 14/359,215

(22) PCT Filed: Nov. 21, 2012

(86) PCT No.: PCT/US2012/066242
§ 371 (c)(1),
(2) Date: May 19, 2014

(87) PCT Pub. No.: WO2013/078300
PCT Pub. Date: May 30, 2013

(65) Prior Publication Data

US 2014/0263485 A1 Sep. 18, 2014

Related U.S. Application Data

(60) Provisional application No. 61/561,959, filed on Nov. 21, 2011.

(51) Int. Cl.

| | |
|---|---|
| ***D06G 3/02*** | (2006.01) |
| ***D06H 3/16*** | (2006.01) |
| ***A41D 27/20*** | (2006.01) |
| ***A46B 5/02*** | (2006.01) |
| ***A46B 5/00*** | (2006.01) |
| ***A46B 15/00*** | (2006.01) |
| ***A47G 25/90*** | (2006.01) |

(52) U.S. Cl.
CPC *D06G 3/02* (2013.01); *A41D 27/20* (2013.01); *A46B 5/005* (2013.01); *A46B 5/02* (2013.01); *A46B 15/0036* (2013.01); *A47G 25/90* (2013.01); *D06H 3/16* (2013.01); *A46B 2200/405* (2013.01)

(58) Field of Classification Search
CPC ..... D06H 3/16; D06G 3/00; D06G 3/02; D06G 3/04; A41D 19/043; A41D 27/20
USPC ..... 223/39, 40, 42
See application file for complete search history.

(56) References Cited

U.S. PATENT DOCUMENTS

| | | | | | |
|---|---|---|---|---|---|
| 1,600,789 | A | * | 9/1926 | Bernhardt | 223/42 |
| 2,489,052 | A | * | 11/1949 | Silva | 223/61 |
| 2,733,844 | A | * | 2/1956 | Gustavison | 223/42 |
| 3,643,840 | A | * | 2/1972 | LeBlanc | 223/42 |
| 4,275,750 | A | * | 6/1981 | Clark | 132/311 |

(Continued)

FOREIGN PATENT DOCUMENTS

| | | | |
|---|---|---|---|
| DE | 20 2006 000 439 | U1 | 6/2007 |
| RU | 46908 | U1 | 8/2005 |

OTHER PUBLICATIONS

Feb. 21, 2013 Search Report issued in International Patent Application No. PCT/US2012/0066242.

*Primary Examiner* — Ismael Izaguirre
(74) *Attorney, Agent, or Firm* — Oliff PLC; R. Brian Drozd

(57) ABSTRACT

A pocket inverter may include a wand and a head connected with the wand. The head may include a barbed portion comprising protrusions that extend outward from a surface of the barbed portion. The protrusions each may have a shape to ensnare fabric in a pocket when the head is inserted inside a pocket and rotated, but prevent the protrusions from piercing through fabric of the pocket.

21 Claims, 6 Drawing Sheets

(56) References Cited

U.S. PATENT DOCUMENTS

| | | | | |
|---|---|---|---|---|
| D313,871 | S * | 1/1991 | Oberheim | D28/35 |
| 5,771,904 | A * | 6/1998 | Lange et al. | 132/159 |
| 6,532,968 | B1 * | 3/2003 | Hafemann | 132/271 |
| 7,716,775 | B2 | 5/2010 | DiPietro et al. | |
| 2003/0192564 | A1 * | 10/2003 | Johnson | 132/119.1 |
| 2010/0251498 | A1 | 10/2010 | Metaxatos et al. | |
| 2011/0000039 | A1 | 1/2011 | Perez | |

* cited by examiner 500
506
502
504
114
402
112
306

602
600
608
608
606
604
402
114
112
306

104

104

104

1002
1004
1000
1004
1002
1006

1104
1100
1102

POCKET INVERTER

FIELD OF THE INVENTION

Embodiments of the present invention relates generally to a device for inverting pockets so that the contents of the pockets may be examined.

BACKGROUND OF THE INVENTION

Law enforcement officers face a wide array of dangers in the performance of their duties. In addition to perils, such as physical assault and vehicular accidents, there are other less obvious threats to the health and wellbeing of these officers. For instance, there are various dangers associated with searching those in custody for weapons or drugs. Arrested individuals may be drug users, having both drugs and other paraphernalia in their pockets, such as needles, knives, or other sharp objects. Although law enforcement officers commonly ask suspects if they are carrying dangerous items, the reply is suspect by nature and must be verified by checking the suspects' pockets.

Also, it is not unusual for a law enforcement officer or medical personnel to be faced with injured, disoriented, and/or unconscious persons who are unable to provide either reliable information or any information at all. Typically, the individual's pockets must be checked. While performing such a check, the law enforcement officers or medical personnel may suffer injuries caused by needles or other dangerous items located in the pockets. Such injuries, in addition to being painful, might require the injured to be screened or treated for a wide variety of infectious conditions.

Some devices used for examining the contents of a pocket incorporate hook or hook-like members to catch or entangle the fabric or lining of the pocket. Other devices utilize tacky or sticky elements, surfaces, or material to catch or adhere to the pocket. It is difficult, however, to reposition such devices if they adhere to an undesired portion of the pocket. For example, if it is desired to insert the device fully into the end of a pocket, it becomes difficult to reposition the device if it catches a portion of the pocket before reaching the end. Moreover, the hook or hook-like members may pierce the pocket's fabric or skin of the detainee, potentially causing damage or injury. Additionally, devices which use tacky or sticky elements may become contaminated when items and material within the examined pockets stick to the devices.

SUMMARY OF THE INVENTION

The present invention recognizes and addresses the foregoing considerations, and others, of prior art construction and methods.

In that regard, one aspect of the present invention provides a device and method of revealing the contents of the pockets of those arrested, detained, or otherwise incompetent without requiring insertion of the hand or fingers into the pockets thereby reducing the dangers to those persons who are required to perform the contents check. Certain aspects of the present invention overcome this difficulty by providing an effective means to invert pockets without reaching therein. Such a device for inverting pockets that is compact enough to be carried by law enforcement officers or medical providers lowers the risk of a required search, and thereby lowers any costs associated with follow-up medical treatment and/or lost work hours.

In one aspect of the present invention, a pocket inverter may include a wand and a head connected with the wand. The head may include a barbed portion comprising protrusions that extend outward from a surface of the barbed portion, the protrusions each comprising a conical shape to ensnare fabric in a pocket when the head is inserted inside a pocket and rotated, but prevent the protrusions from piercing through fabric of the pocket.

In another aspect of the present invention, a method of operating a pocket inverter is provided. The pocket inverter may include a wand comprising telescoping elements, and a head connected with the wand. The head may include a barbed portion comprising protrusions that extend outward from a surface of the barbed portion. The protrusions each may include a conical shape to ensnare fabric in a pocket when the head is inserted inside a pocket and rotated, but prevent the protrusions from piercing the fabric. The telescoping elements are extended to a desired length, and the head is inserted into a pocket. Once the head is inserted to the pocket to a desired location, the head is rotated in a first direction in order to allow the protrusions to catch the inside of the pocket and ensnare a portion of the pocket material to turn the pocket inside out.

In another aspect of the present invention, a pocket inverter is provided with an elongated body and at least one strip. The elongated body includes a first end, a second end, and an interior, the first end defining a slot. The strips are disposed in the elongated body's interior and include a barbed portion located proximate to the first end. The strips are also extendable through the slot. The barbed portion is configured to ensnare fabric in a pocket when the barbed portion is extended from the elongated body, but prevent the protrusions from piercing through fabric of the pocket. The strips are curved when extended from the elongated body.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
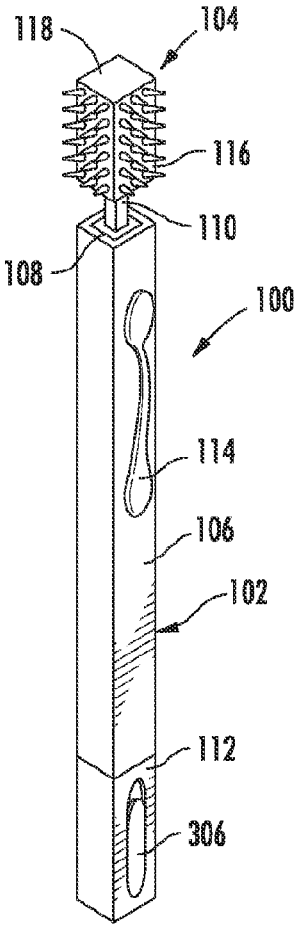
FIG. 1 is a perspective view of a pocket inverter in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
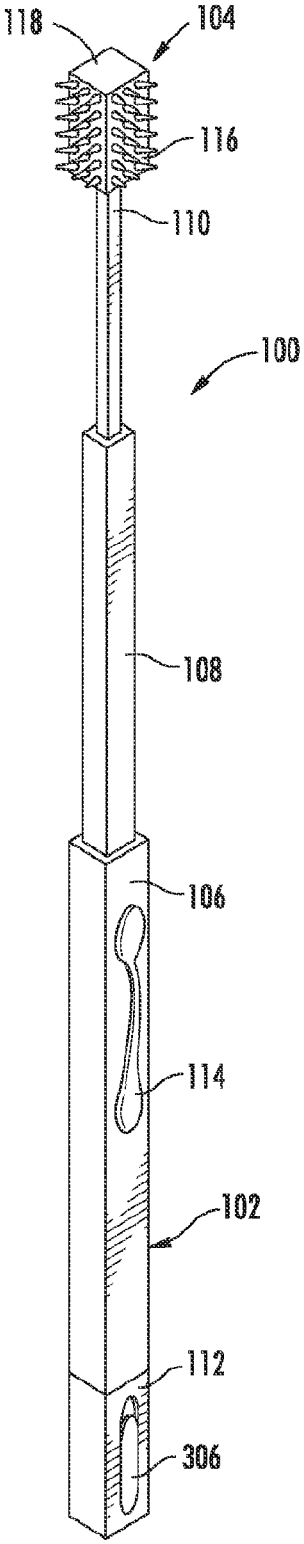
FIG. 2 is a perspective view of the pocket inverter of FIG. 1 in an extended position.

FIGS. 1 and 2 illustrate a pocket inverter 100 in accordance with an embodiment of the present invention. Pocket inverter 100 comprises a wand portion 102 and a head portion 104. In this embodiment, head portion 104 is cuboid, but it should be understood that the head portion may exhibit various shapes, such as a rectangular prism, cylindrical, or a cube, depending on the intended use of the device. Head portion 104 is approximately the size of an eraser attached to the end of a pencil but may be other various sizes depending on the inverter's intended uses.

As shown, wand portion 102 includes a plurality of telescoping elements 106, 108, and 110. Although three telescoping elements are depicted, it should be understood that pocket inverter 100 may include various numbers of telescoping elements depending on the desired size, configuration, and use of pocket inverter 100. In a preferred embodiment, pocket inverter 100 is approximately the size of a writing utensil, such as an ink pen, when in the compact configuration shown in FIG. 1. It should also be understood that telescoping elements 106 and 108 are hollow in order to receive portions 108 and 110, respectively, when in the compact configuration. As explained in more detail below, element 110 may also be hollow to allow for the transmission of light down the entire length of wand portion 102, as described in more detail below. In the presently-described embodiment, wand portion 102 additionally comprises base portion 112. Pocket inverter may also comprise a clip 114, which allows the device to be carried in a shirt pocket or small pouch similar to the manner by which a pen may be carried.

In the presently-described embodiment, head portion 104 comprises a barbed portion 116 and a non-barbed portion 118. Barbed portion 116 is comprised of a plurality of frustroconical protrusions that extend perpendicularly outward with respect to each surface of the barbed portion from which the respective protrusion extends. The length and width of the protrusions enable barbed portion 116 to ensnare the fabric of a pocket when head portion 104 is inserted inside a pocket and rotated, as described below, but prevent the protrusions from piercing the fabric. In the present embodiment, a top and a bottom surface of cuboidal head portion 104 comprise non-barbed portion 118. Head portion 104 may be constructed from hard injection molded plastic, but it should be understood that head portion 104 may also be constructed from other suitable materials, such as metal, plastic, rubber, or a combination thereof.

In some embodiments, the protrusions extend (and/or point) in a common direction about the periphery of the surface of the barbed portion so that if the head portion is moved (or rotated) in such common direction the protrusions ensnare the material it encounters during such movement, but if the head portion is moved (or rotated) in a direction that is opposite such common direction, the head portion will not ensnare the material it encounters. For example, if the barbed portion is a cylinder, the protrusions may all be pointing or aligned toward the base of the wand portion 102 (so that if base of the wand portion is placed proximate to a surface and perpendicular to such surface with the head portion distal from the surface, the protrusions on the head portion extend from the head portion and point toward the base of the wand portion). In this regard, when the head portion is inserted into the pocket (in a direction that is substantially opposite of the direction that the protrusions point), the protrusions do not ensnare the pocket material. However, when the head portion is then attempted to be removed from the interior of the pocket (i.e., the head portion is moved in a directed that is the same direction as where the protrusions point), the protrusions then ensnare the material in the pocket (thereby inverting the pocket). In another embodiment, head portion 104 has a spherical shape and the protrusions each point in a common circular direction (and each protrusion may be aligned with a tangent to the sphere at the location of each respective protrusion). For example, as viewed from above, the protrusions could all be pointing in a clockwise fashion about the sphere so that when the head is rotated in a counterclockwise motion, the material in the pocket is not ensnare, but is ensnared when the head portion is rotated in a clockwise motion. In this regard, the protrusions may not be orientated perpendicular to the surface of head portion 104 but instead are aligned in a direction that is opposite of the direction that the user will move the head portion to ensnare the material (e.g., the protrusions all point in a common circular direction if the user intends to ensnare material by rotation in a direction that is the same as the circular direction that the protrusions point, the protrusions point back towards the base or handle of the wand portion if the user intends to ensnare material by moving the head portion toward the based or handle of wand portion, or the protrusions may be orientated in any other common direction which is the direction that the user wishes to move the head portion to ensnare the material).

Additionally, it should be noted that the protrusions are relatively small burrs on the head portion. These burrs may be between one millimeter and 500 millimeters long and between 1-500 mms in diameter. Any number of relatively small burrs may be included on head portion 104, such as between 20 and 1000 burrs.

In the presently-described embodiment, head portion 104 is hollow and affixed to telescoping portion 110. Alternatively, head portion 104 may be translucent and/or solid, depending on the intended use of the device. In the current embodiment, wand portion 102 is constructed from plastic but may alternatively be constructed from other suitable materials, such as metal.

Figure 3:
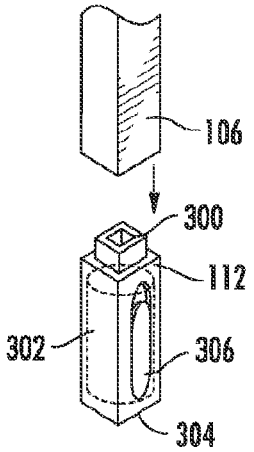
FIG. 3 is a perspective view of the base of the pocket inverter of FIG. 1 detached from the adjacent telescoping element.

FIG. 3 illustrates base portion 112 of wand portion 102 detached from telescoping portion 106. Base portion 112 comprises a suitable light source such as a light emitting diode ("LED") 300, which is powered by an internal battery 302. The bottom surface of base portion 112, indicated at 304, preferably includes means for providing access to battery 302 in order to replace the battery when necessary, although embodiments are contemplated in which the base portion is replaceable as a unit. A switch 306 that is operatively connected to LED 300 and battery 302 is configured to activate the LED. Referring additionally to FIG. 2, light produced by LED 300 is transmitted through telescoping elements 106, 108, and 110 to illuminate head 104 (which, in this embodiment, is formed of a suitable translucent material). Head 104, thus illuminated, allows a user to identify the head's location when inserted into a pocket and may also reveal any items in the pocket. Additionally, because base 112 may be detached from element 106 in the illustrated embodiment, LED 300 can be used independently as a small flashlight.

Figure 17:
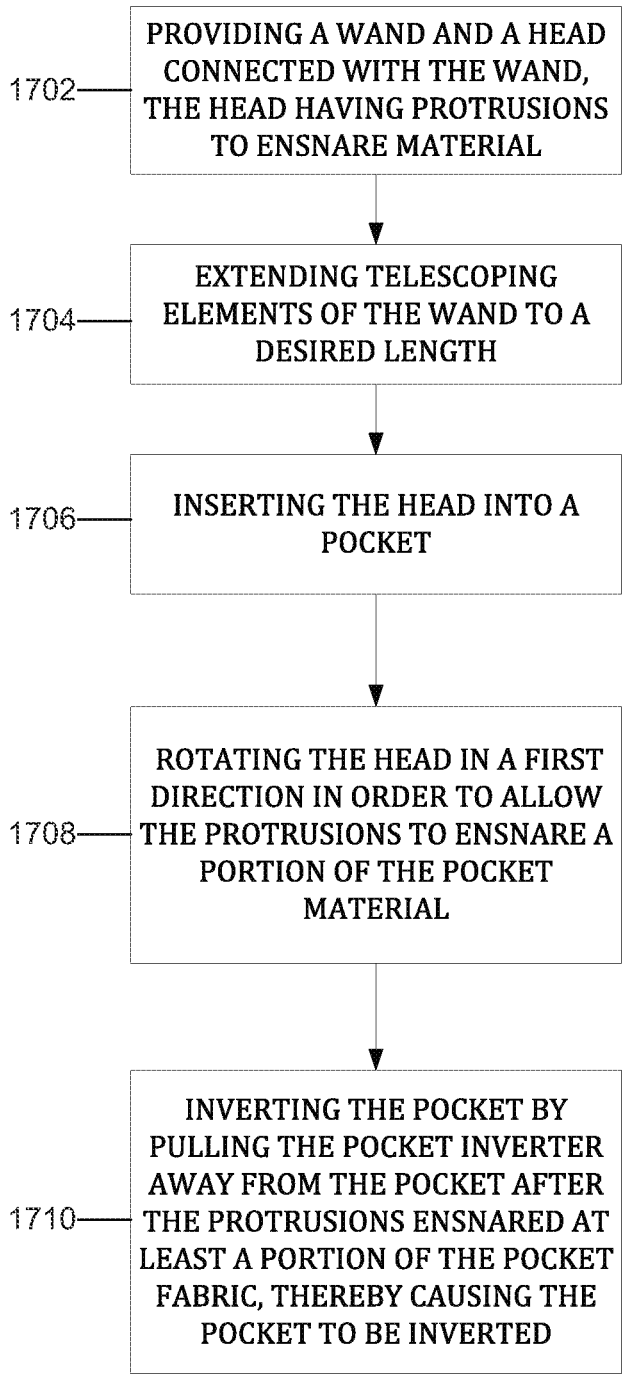
FIG. 17 is a method of operation of a pocket inverter in accordance with various embodiments of the present invention.

Referring to FIG. 17 (as well as FIGS. 1, 2, and 3), in operation, a user provides a pocket inverter as discussed above (step 1702 of FIG. 17) and extends telescoping portions 106, 108, and 110 to a desired length and inserts head portion 104 into a pocket (step 1704 of FIG. 17). The head portion 104 of the pocket inverter is inserted into the pocket (step 1706 of FIG. 17). The user may activate LED 300 via switch 306 either before or after inserting head portion 104 into the pocket. Once the user has inserted head portion 104 to a desired location within the pocket, the user rotates or twists pocket inverter 100 in order to allow barbed section 116 to catch the inside of the pocket and gather some of the pocket material (step 1708 of FIG. 17). To invert the pocket, the user pulls head portion 104 from the pocket by pulling the pocket inverter away from the pocket (step 1710 of FIG. 17). As a result, pocket inverter 100 pulls the pocket material along with head portion 104 as it is removed from the pocket. The pocket is thus inverted, causing any contents to fall out or to otherwise become exposed.

If the user chooses not to invert the pocket, the user rotates pocket inverter 100 in the direction opposite to the direction the inverter was previously rotated. As a result, the pocket's material is released from barbed portion 116. The user then removes head portion 104 from the pocket without inverting the pocket. After using the pocket inverter, the user retracts wand portion 102 and stores the pocket inverter. Clip 114 may be used to secure the pocket inverter, such as to the user's shirt pocket when not in use.

In the presently-described embodiment, telescoping elements 106, 108, and 110 are polygonal (e.g., square, rectangular, triangular, etc.) in cross section which allows a user to distinguish inverter 100 from other objects such as pens having a cylindrical shank. The square cross-section of telescoping elements 106, 108, and 110 also prevents them from rotating with respect to each other during use. Preferably, telescoping elements 106, 108, and 110 will temporarily lock into place when extended in order to prevent the telescoping portions from collapsing when undesired. In this embodiment, additional force is used to collapse elements 106, 108, and 110 in order to return pocket inverter 100 to the compact configuration. If the telescoping portions are cylindrical (as described below), the locking mechanism may be further adapted to prevent relative rotation between the telescoping elements.

Figure 4:
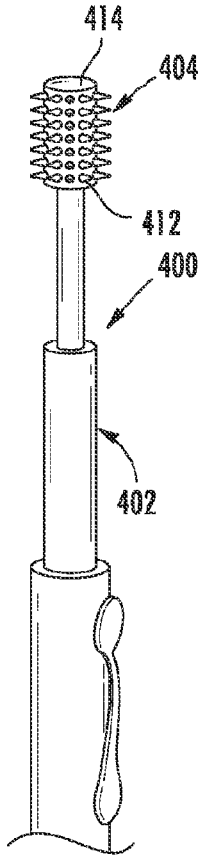
FIG. 4 is a perspective view of a pocket inverter in accordance with an embodiment of the present invention.

FIG. 4 illustrates a pocket inverter 400 in accordance with another embodiment of the present invention. Pocket inverter 400 comprises a wand portion 402 and a head portion 404 similar to pocket inverter 100 (FIG. 1). In this embodiment, however, the telescoping portions that comprise wand portion 402, as well as head portion 404, are cylindrical. Head portion 404 includes a barbed portion 412. The protrusions comprising barbed portion 412 extend radially from the axis created by wand portion 402 and head portion 404 and extend radially from the barbed portion's surface. Top surface 414 of the head portion is flat and does not include barbs in this embodiment. Pocket inverter 400 is otherwise similar in both construction and operation to pocket inverter 100 (FIG. 1).

Figures 5, 6, 7, 8, 9, 10, 11:
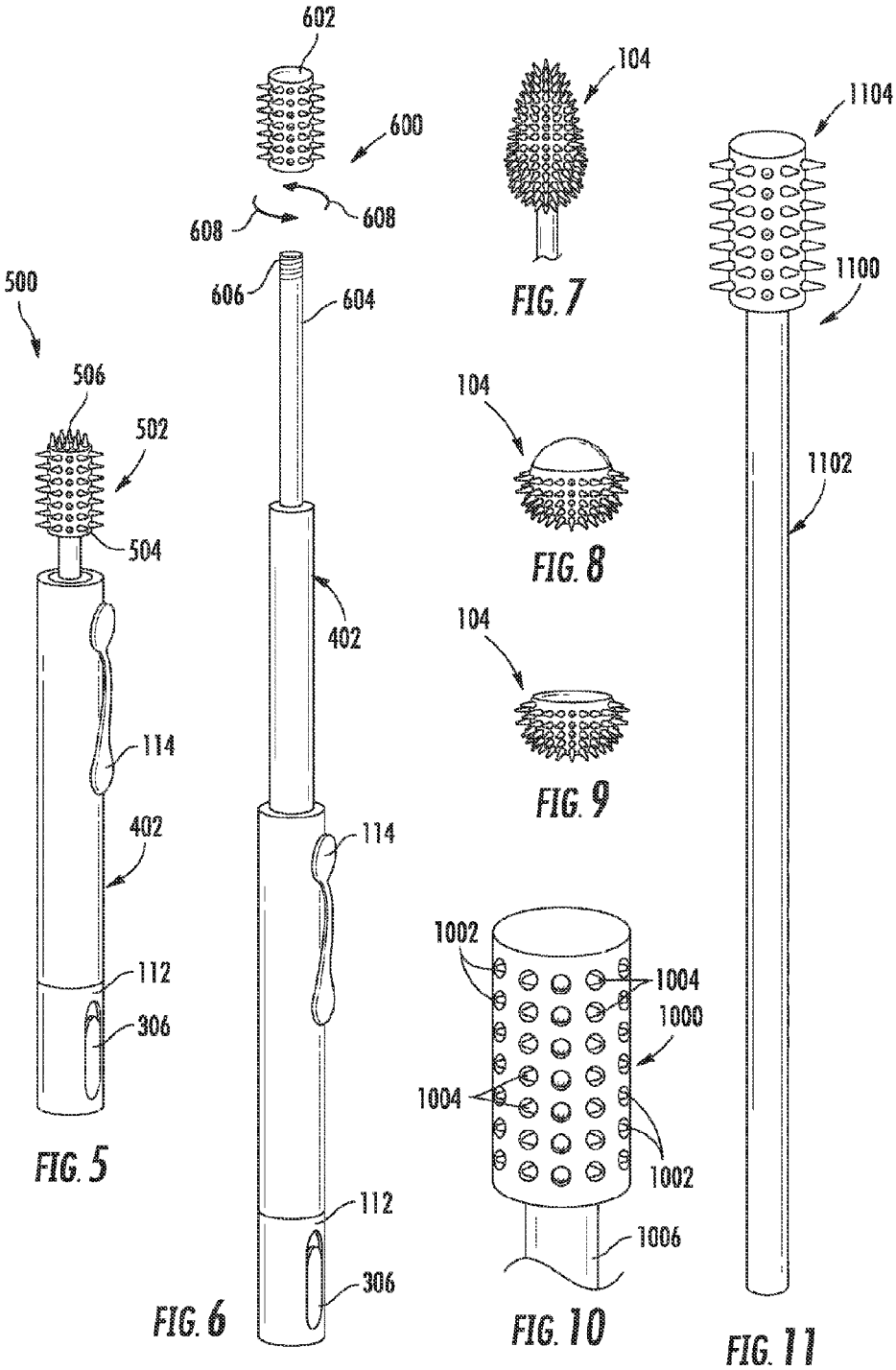
FIG. 5 and FIG. 6 are perspective views of pocket inverters in accordance with various embodiments of the present invention.
FIGS. 7, 8, 9, and 10 are perspective views of pocket inverter tips in accordance with various embodiments of the present invention.
FIGS. 11, 12, 13, and 14 are perspective views of pocket inverters in accordance with various embodiments of the present invention.

FIG. 5 illustrates a pocket inverter 500 in accordance with another embodiment of the present invention. Pocket inverter 500 comprises a wand portion 402 and a head portion 502. The external surface 504 of head portion 502 is covered with barbs, including top surface 506. Pocket inverter is otherwise similar in both construction and operation to pocket inverter 400 (FIG. 4).

FIG. 6 illustrates a pocket inverter 600 in accordance with another embodiment of the present invention. Pocket inverter 600 comprises a detachable head portion 602 configured to connect to cylindrical telescoping element 604. Head potion 602 may be rotated (denoted by arrows 608) in order to detach from and attach to element 604, such as via screw threads 606. Pocket inverter 600 is otherwise similar in both construction and operation to pocket inverter 400 (FIG. 4). It should be understood that any suitable method may be used to connect head portion 602 to telescoping element 604 in this embodiment as long as the head portion may be detached and reattached to the wand portion. This allows replacement of head portion 602 should it become contaminated or for any other reason.

It should be understood that the present invention contemplates other suitable configurations and shapes of the head portions described herein without departing from the scope of the present invention should they be desired. For instance, FIGS. 7, 8, and 9 illustrate various exemplary shapes for the head portions, such as for head portion 104. It should be understood that barbs oriented in the direction of the user, such as those illustrated in FIG. 7, allow the user to insert the pocket inverter into a pocket, catch the pocket's material, and retract without necessarily rotating the inverter. In the instances of a relatively deep pocket, the user may retract the pocket's material, grasp the exposed material, reinsert the inverter into the pocket, and repeat as many times as necessary to expose the entire pocket and its contents.

FIG. 10 illustrates head portion 1000 in accordance with another embodiment of the present invention. Head portion 1000 defines a plurality of apertures 1002. A plurality of barbs 1004 is located inside cylindrical head portion 1000, such that each barb 1004 corresponds with a respective aperture 1002. Barbs 1004 are operatively connected to telescoping portion 1006, such that rotation of the wand portion causes each barb to extend through the respective aperture. Once portion 1006 is rotated to a certain extent, portion 1006 locks into place and barbs 1004 lock into a fully extended configuration.

In operation, the user inserts head portion 1000 into a pocket and rotates the wand portion, thereby causing barbs 1004 to extend through apertures 1002 and come into contact with the pocket's fabric or other material. Once portion 1006 is rotated, the user then proceeds in the manner described above with respect to FIGS. 1, 2, and 3 to invert the pocket to the extent it locks into place, the user may rotate the pocket inverter in a manner similar to those described above. Accordingly, the present embodiment allows the user to insert the pocket inverter into a pocket without fear of catching the barbs on the pocket's fabric before being inserted to a desired depth within the pocket.

FIG. 11 illustrates a pocket inverter 1100 comprising a fixed-length wand portion 1102 and a head portion 1104 similar to that described above with respect to inverter 400 of FIG. 4. Wand portion 1102, however, is a single continuous member rather than comprising telescoping elements similar to those shown in FIG. 4. While such a configuration eliminates the necessity to extend and contract wand portion 1102 before and after each use, the configuration eliminates the convenience of retracting and storing pocket inverter 1100 in a location capable of storing pocket inverter 400 (FIG. 4).

Figure 12:
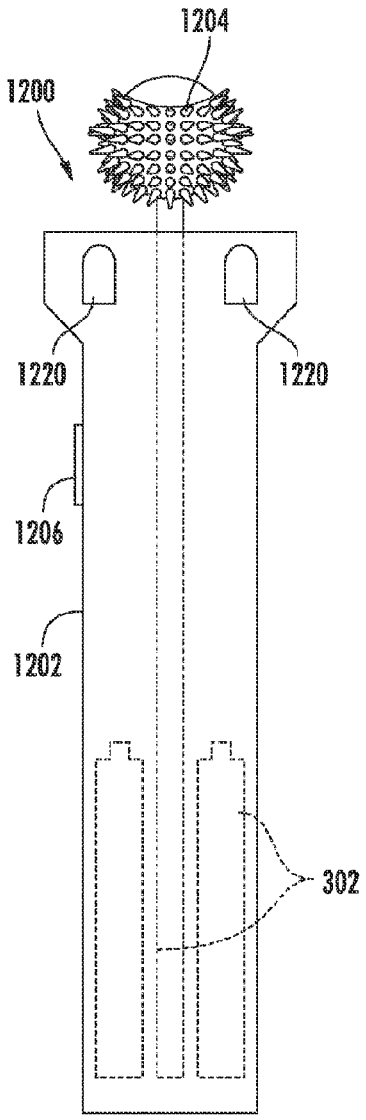

FIG. 12 illustrates a pocket inverter 1200 in accordance with another embodiment of the present invention. In this embodiment, pocket inverter 1200 comprises a wand portion 1202 and a head portion 1204. Wand portion 1202, however, is of hollow construction to house at least one battery 302 in the bottom portion of the wand and at least one LED 1220 in the wand's top (or forward) portion as illustrated. Those skilled in the art should appreciate that the embodiment shown in FIG. 12 illustrates inverter 1200 having two batteries 302 and two LEDs 1220. A switch 1206 is operatively connected to LEDs 1220 and batteries 302 and configured to activate the LEDs. Wand portion 1220 may contain at least one telescoping element illustrated in broken lines similar in operation and construction to the telescoping elements described above with respect to pocket inverter 400 (FIG. 4).

Figure 13:
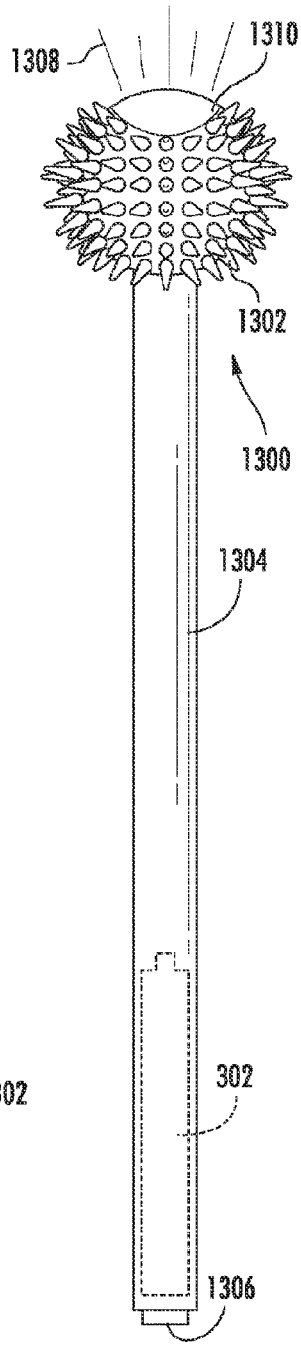

FIG. 13 illustrates a pocket inverter 1300 in accordance with another embodiment of the present invention. Pocket inverter 1300 comprises a head portion 1302 and a wand portion 1304 similar to that described above with respect to wand portion 1102 of FIG. 11. Wand portion 1304, however, is configured to house a battery 302 for the purpose of powering an LED housed in head portion 1302. The bottom surface of the wand portion includes a switch 1306 that is operatively connected to the LED and battery 302 and configured to activate the LED. Activation of the LED causes light to emit through a portion 1310 of head portion 1302 as denoted at 1308. As a result, the light allows pocket inverter 1300 to be utilized in examining recesses and darkened portions of vehicles, luggage, homes, etc. similar in nature to a flashlight. Additionally, such a lighted tip may be utilized to examine a suspect's pupils or outer body, as well as to provide a light for the suspect to follow during the administration of sobriety tests.

Figure 14:
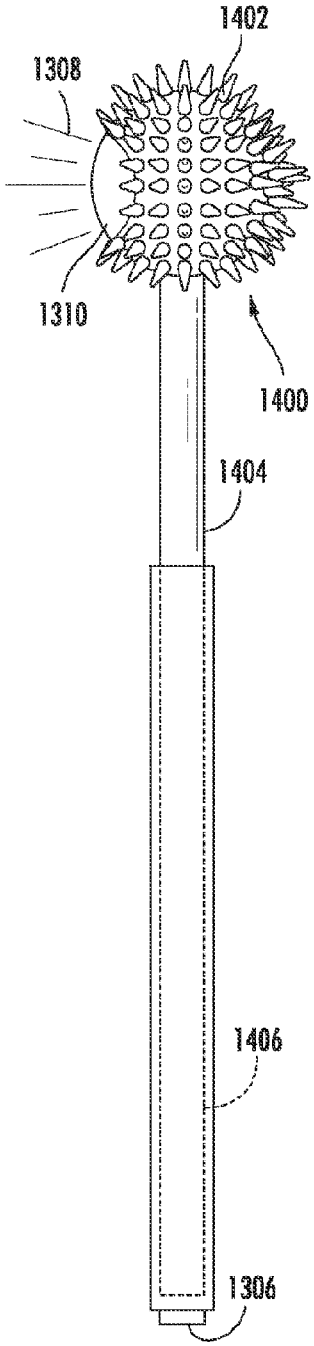

FIG. 14 illustrates a pocket inverter 1400 similar to inverter 1300 described above with respect to FIG. 13, but that includes a telescoping element 1404. Pocket inverter 1400 includes a head portion 1402 and a fixed wand portion 1406. Pocket inverter 1400 also includes a battery and a switch 1306, similar to those described above with respect to FIG. 13. In the presently-described embodiment, illuminated portion 1310 of head portion 1402 is oriented in a direction perpendicular to the axis of wand portions 1404 and 1406. As a result, light emitted by pocket inverter 1400 (denoted at 1308) radiates away from the inverter in a direction perpendicular to the inventor's longitudinal axis. This iteration would serve to more efficiently enter deep pockets, minimizing the necessity for multiple insertions and retractions, as well as to penetrate farther into other recesses requiring inspection, as explained above. It should be understood that lighted region 1310 may be located in a number of areas on head portion 1402 and may be oriented in different directions as desired. FIGS. 13 and 14 thus serve to illustrate two possible embodiments. Pocket inverter 1400 is otherwise similar in both construction and operation to pocket inverters 600 (FIG. 6), 1100 (FIG. 11), and 1300 (FIG. 13).

In another embodiment, head portion 1402 is formed by a molded plastic injection process and may be translucent. As a result, the entire head portion including the barbs, may form the LED's housing and/or may be illuminated by the LED.

In another embodiment, a bag is attached to the pocket inverter's base so that any contents removed from the pocket may fall into the bag. The bag may be attached to the base by means of a slit within the base portion or by any other suitable means, such as a clip or clamp.

It should be understood that the above description provides a pocket inverters that may be used to examine the contents of an individual's pocket while reducing the risk of damage or injury. The embodiments of the pocket inverters described above provide other benefits that may be advantageous to the user. It should also be understood from the above description that the pocket inverter described herein may be telescoping or have a fixed length, solid or hollow, illuminated on non-illuminated, and any combination thereof. If illuminated, the lighting mechanisms may be positioned anywhere on the pocket inverter. Those skilled in the art should appreciate that the location of the switch operatively connected to the lights and associated power source to activate the lights is not crucial to the proposed solution and may be located as desired. Additionally, the protrusions or barbs may be located, oriented, and shaped as desired, depending on the intended use of the inverter.

It should also be understood that the size and orientation of the barbs located on the head portion of the pocket inverter, as well as their location on the head portion, may be altered without departing from the scope of the present invention. In certain embodiments, for instance, the barbs may exhibit a relatively smaller cross-section than those illustrated in the attached figures. By way of an example, the size of head 1302 and 1402, as well as the barbs located thereon, illustrated in FIGS. 13 and 14, respectively, may exhibit a smaller cross-section in comparison to wand portions 1304 and 1404, respectively, than those illustrated. In other embodiments, the barbs may exhibit an orientation where they are directed toward the user's hand, such as that shown in FIG. 9, but may cover the majority of the head, such as that shown in FIG. 6, or the entire head, such as that shown in FIG. 7. Moreover, it should be appreciated that the end or "tip" of each barb may be altered without departing from the scope of the present invention. For instance, the tips of the barbs may exhibit an orientation and direction different from the rest of the associated barb. Referring specifically to FIGS. 1, 2, and 4, for example, the tips of the barbs may be altered to be directed toward the inverter's base or towards the user, while the barbs themselves remain directed perpendicular to the axis defined by the wand portion.

It should be further understood that the head portion may simply be a portion of the wand portion and need not be a different shape than the wand portion. For example, FIG. 16 illustrates that the head portion may be an extension to the wand portion and need not have a different shape.

Additionally, it should be understood that the barbs or protrusions may be replaced with a material that has a high coefficient of friction, such as a piece of rubber material or vinyl material. In this regard, the material may have a relatively large surface area so that the amount of friction between the pocket material and the material is great so that the material will be ensnared with the material using friction instead of piercing the material.

Other embodiments of the pocket inverter are possible and the above embodiments should not be so limited. For example, some additional embodiments are illustrated in FIGS. 15-16.

Figures 15A, 15B, 15C:
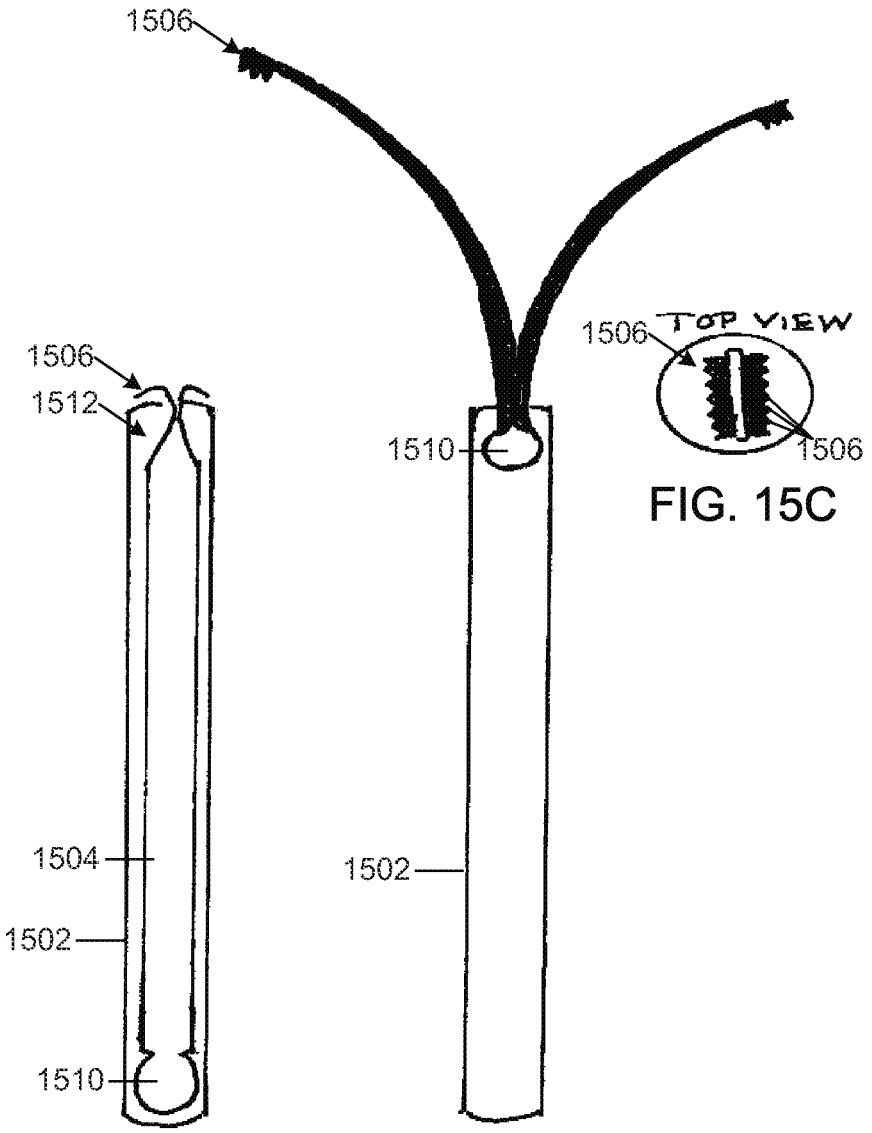
FIGS. 15A, 15B, 15C illustrate a pocket inverter and portions thereof in accordance with various embodiments of the present invention.

In FIGS. 15A-B, a thin strip of metal 1504, such as spring steel or other metal with micro teeth 1506 defined in the exposed end 1506, may be placed within the hollow portion 1512 of the wand 1502 and extended through a slot for inverting the pocket. Metal strip 1504 is connected to a common base 1510 which connects metal strip 1504 to wand 1502. If the metal strip 1504 is comprised of a single strip doubled within the handle (as illustrated in FIG. 15), the pocket inverter has two metal strip ends extending the slot. An advantage of a doubled metal strip configuration of FIG. 15 is that the position where the strip is bent is a configuration that would preclude it slipping thru the slot during extension. The tension of the pre-bent strip would allow it to be reinserted into the handle with little pressure and would require no catch to hold it in the stowed position (FIG. 15A). A strip that has been pre-bent to a curved shape prior to insertion into the hollow handle would return to this shape upon extension (FIG. 15B) providing easy contact with the interior surface of the pocket or recess. A doubled strip as described above opens into V-shape and provides contact at two points of the recess. This would result in a larger, more open portion of the recess being revealed as the wand is retracted.

In FIG. 15, the metal strips are extended from the wand portion and then form a curved V shape as illustrated in FIG. 15. The metal strips are then inserted into the pocket. The heads of the metal strips ensnare the interior material of the pocket when they are removed from the pocket due to the protrusions at the tip of the metal strips.

Figure 16A:
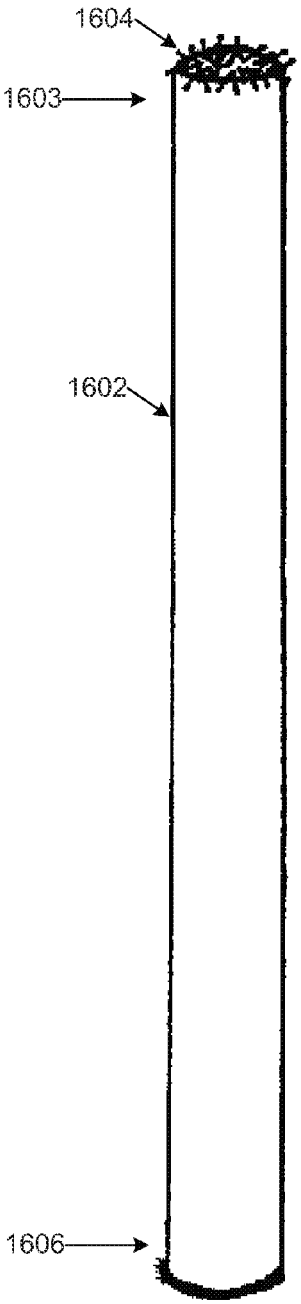
FIGS. 16A, 16B, 16C, and 16D illustrate a pocket inverter and portions thereof in accordance with various embodiments of the present invention.
Figure 16B:
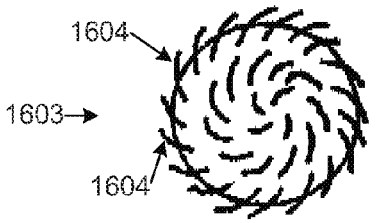
Figure 16C:
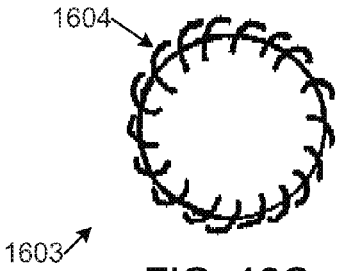
Figure 16D:
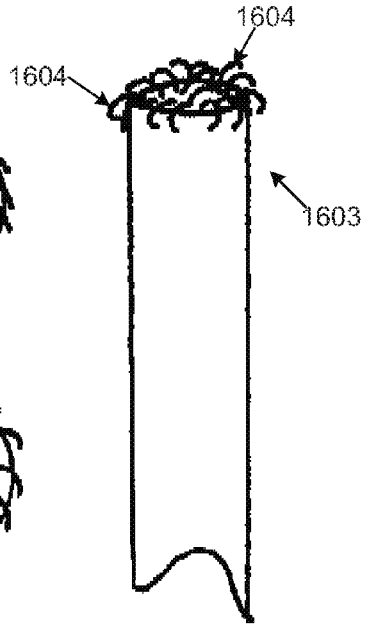

In the embodiment of FIG. 16, the wand portion is a non-telescoping tube with a burr head surface designed so that the tips of the micro teeth are pointed toward the base of the tube as shown in FIG. 16D. With this design, the wand portion would be inserted into the pocket or recess (with the head portion inserted first) and the head portion then pulled out with the pocket material being inverted as it is retracted. For deep pockets or recesses the wand portion would be retracted, exposing a portion of the pocket or recess that would be held in its partially exposed position by the other hand as the wand is reinserted and retracted until the entire recess is exposed. Upon insertion, the alignment of the micro teeth toward the base of the wand portion allows the head portion of the pocket inverter to slide smoothly into the recess and to only engage the material of the recess as it is retracted.

The tip of the wand portion could also incorporate micro teeth oriented in different directions and should not be limited to the above-described embodiment. As an example, the micro teeth of the largest circumference of the head portion could be oriented at a right angle to the wand portion so that the device could be rotated to engage and trap the material of the recess if the contents are heavy or cumbersome while the micro teeth situated nearer the base of the wand portion could be facing the base so that the wand could be inserted and retracted as described above.

A hollow tube would allow a battery to be inserted so that the tip of the burr could contain an LED that would allow the device to be utilized in examining recesses and darkened portions of vehicles, luggage, homes etc. Additionally, such a lighted tip may be utilized to examine the suspect's pupils or outer body as well as to provide a light to follow with the eyes while administering sobriety tests. The lighted portion may be placed inside the tip with selected openings provided so that the light may escape in the desired direction. The entire burr could be comprised of a light emitting diode whose exterior surface is formed to produce the micro teeth or simply manufactured so that the micro teeth result from the encapsulating liquid material of the LED being placed in a mold designed to form the micro teeth upon hardening.

Either of the above configurations could utilize a telescoping extension tip (as illustrated in FIG. 15). This embodiment serves to more efficiently enter deep pockets, thereby negating the necessity for multiple insertions and retractions as well as to penetrate further into other recesses requiring inspection.

In another embodiment illustrated at FIG. 16, a simple arrangement of short wires 1604 could be placed at the tip 1603 of the wand portion 1602. These wires may have a length that engages the material of the pocket's interior but not extend through such material to pose a danger to the person being searched. Wires 1604 could be arranged in a spiral fashion so that the wand is twisted to catch the material or with wires 1604 pointed back toward the base 1606 for use in a simple insert and pull back fashion.

A smooth material such as rubber or leather that exhibits a high coefficient of friction could also be utilized as a means to engage the material of the pocket. This material could also be roughened, machined or provided with tips inserted into the material to enhance its efficiency.

It should be noted that the design of the pocket inverter (or any portion thereof) can be incorporated into the design of other products such as flashlights or tactical batons, and thus need not be a stand-alone device. For example, for flashlights, the pocket inverter herein could be incorporated into the circumference of the lighted end or as an attachment in the manner of a bayonet, fixed rod, or folding rod. Also, the head of the pocket inverter could be implemented on a tactical baton to add additional functionality to the baton.

Those skilled in the art should appreciate that the barbs of the pocket inverter are manufactured and fashioned in a manner that negates any danger due to use of the inverter. The size and composition of the barbs, such as being smaller than the associated wand portion and being made of rubber, for example, reduces the likelihood that anyone or anything is injured or damaged due to the inverter's use. That is, the tip of each barb exhibits a very small surface area designed to only engage the material of the targeted pocket and poses no danger of damaging any skin adjacent thereto.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. For example, aspects of one embodiment may be combined with aspects of other embodiments to yield still further embodiments. Therefore, it is contemplated that any and all such embodiments are included in the present invention as may fall within the scope and spirit thereof.

What is claimed is:

1. A pocket inverter comprising:

a wand; and a head connected with the wand and comprising a barbed portion comprising protrusions that extend outward from a surface of the barbed portion, each of the protrusions are orientated in a common radial direction around a tip of the wand, and each of the protrusions are configured to ensnare fabric in a pocket when the head is inserted inside a pocket and rotated in the same direction as the radial direction that the protrusions are orientated in.

2. The pocket inverter of claim 1, wherein the protrusions are configured to prevent piercing through fabric of the pocket.

3. The pocket inverter of claim 1, wherein the protrusions have a conical shape.

4. The pocket inverter of claim 1, wherein the wand comprises telescoping elements to allow the head to be extended from a base of the wand.

5. The pocket inverter of claim 4, wherein the telescoping elements each have a polygonal cross-sectional shape.

6. The pocket inverter of claim 4, wherein the telescoping elements comprise a hollow interior and wherein the wand further comprises a base portion that comprises a light configured to illuminate through the hollow interior of the telescoping elements.

7. The pocket inverter of claim 6, wherein the base portion is connected to the telescoping elements so that the light illuminates from the base portion to the head.

8. The pocket inverter of claim 7, wherein the head comprises a portion which allows the light to travel from an interior of the head to an environment surrounding the head.

9. The pocket inverter of claim 4, wherein the head is removably connectable with the telescoping elements.

10. The pocket inverter of claim 1, wherein the wand comprises a unitary piece of a fixed length so that the length of the wand is fixed.

11. The pocket inverter of claim 1, wherein the head is shaped to one of a cylinder, a cuboid, or a sphere.

12. The pocket inverter of claim 1, wherein the head further comprises apertures and wherein the protrusions comprise barbs, wherein the barbs are initially located inside the head such that each barb corresponds with a respective aperture.

13. The pocket inverter of claim 12, wherein the barbs are operatively connected to telescoping elements of the wand such that rotation of the wand causes each barb to extend through the respective apertures.

14. The pocket inverter of claim 13, wherein the barbs are configured to lock into place into a fully extended configuration once the wand is rotated to a certain extent.

15. A method of operating a pocket inverter, comprising:

providing a wand comprising telescoping elements, and a head connected with the wand, the head comprising a barbed portion comprising protrusions that extend outward from a surface of the barbed portion, each of the protrusions are orientated in a common radial direction around a tip of the wand, and each of the protrusions are configured to ensnare fabric in a pocket when the head is inserted inside a pocket and rotated in the same direction as the radial direction that the protrusions are orientated in;

extending the telescoping elements to a desired length;

inserting the head into a pocket; and rotating the head, once the head is inserted to the pocket to a desired location, in a first direction in order to allow the protrusions to ensnare a portion of the pocket material.

16. The method of claim 15, further comprising activating a light disposed in the pocket inverter before or after inserting the head into the pocket.

17. The method of claim 15, further comprising inverting the pocket by pulling the pocket inverter away from the pocket after the protrusions ensnared at least a portion of the pocket fabric, thereby causing the pocket to be inverted.

18. The method of claim 17, further comprising rotating the head in a direction opposite of the first direction to release the pocket material from the protrusions.

19. The method of claim 15, further comprising rotating the head of the pocket inverter, causing each protrusion to extend through respective apertures in the head.

20. A pocket inverter comprising:

an elongated body comprising a first end, a second end, and an interior, the first end defining a slot; and at least one strip disposed in the elongated body's interior and comprising a barbed portion located proximate to the first end and being extendable through the slot, the barbed portion being configured to ensnare fabric in a pocket when the barbed portion is extended from the elongated body, wherein the at least one strip being curved when extended from the elongated body.

21. The pocket inverter of claim 20, wherein the at least one strip comprises two strips, wherein each of the two strips comprises a plurality of tip portions to ensnare the pocket fabric and configured to extend from the elongated body through the slot so that the two strips being curved and extending away from each other when fully extended.

* * * * *